US008555675B2

(12) United States Patent
Beck et al.

(10) Patent No.: US 8,555,675 B2
(45) Date of Patent: Oct. 15, 2013

(54) FABRIC TREATMENT APPLIANCE WITH STEAM BACKFLOW DEVICE

(75) Inventors: Markus Beck, Remseck (DE); Robert J. Pinkowski, Baroda, MI (US); Alvaro Vallejo Noriega, St. Joseph, MI (US); Nyik Siong Wong, St. Joseph, MI (US); Raveendran Vaidhyanathan, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1808 days.

(21) Appl. No.: 11/848,543

(22) Filed: Aug. 31, 2007

(65) Prior Publication Data

US 2009/0056387 A1 Mar. 5, 2009

(51) Int. Cl.
*D06F 37/00* (2006.01)
*B08B 3/12* (2006.01)

(52) U.S. Cl.
USPC ..... 68/3 R

(58) Field of Classification Search
None
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz, Jr. |
| 3,234,571 | A | 2/1966 | Buss |
| 3,347,066 | A | 10/1967 | Klausner |

(Continued)

FOREIGN PATENT DOCUMENTS

| | | | |
|---|---|---|---|
| CA | 1330526 | C | 7/1994 |
| CN | 1664222 | A | 9/2005 |

(Continued)

OTHER PUBLICATIONS

V-Zug Ltd Washing Machine Adora SL; User Manual; V-Zug AG, CH-6301 Zug, 2004; V-Zug Ltd Industriestrasse 66, 6301 Zug, Tel. 041 767 67 67.

*Primary Examiner* — Michael Barr
*Assistant Examiner* — Jason Ko
(74) *Attorney, Agent, or Firm* — Clifton G. Green; McGarry Bair PC

(57) ABSTRACT

A fabric treatment appliance according to one embodiment of the invention comprises a receptacle defining a fabric treatment chamber for receiving laundry, a steam generator having an inlet for receiving water from a water supply and an outlet for supplying steam to the fabric treatment chamber, and a liquid trap upstream from the steam generation chamber blocking backflow of steam from the steam generation chamber to the water supply conduit.

16 Claims, 11 Drawing Sheets

(56) References Cited

U.S. PATENT DOCUMENTS 3,498,091 A 3/1970 Mason
3,550,170 A 12/1970 Davis
3,697,727 A 10/1972 Neuman et al.
3,707,855 A 1/1973 Buckley
3,712,089 A 1/1973 Toth
3,801,077 A 4/1974 Pearson
3,830,241 A 8/1974 Dye et al.
3,869,815 A 3/1975 Bullock
3,890,987 A 6/1975 Marcussen et al.
3,935,719 A 2/1976 Henderson
4,020,396 A 4/1977 Gambale et al.
4,034,583 A 7/1977 Miessler
4,045,174 A 8/1977 Fuhring et al.
4,108,000 A 8/1978 Norris
4,177,928 A 12/1979 Bergkvist
4,207,683 A 6/1980 Horton
4,214,148 A 7/1980 Fleischhauer
4,263,258 A 4/1981 Kalasek
4,332,047 A 6/1982 Kuttelwesch
4,373,430 A 2/1983 Allen
4,386,509 A 6/1983 Kuttelwesch
4,432,111 A 2/1984 Hoffmann et al.
4,489,574 A 12/1984 Spendel
4,496,473 A 1/1985 Sanderson
4,527,343 A 7/1985 Danneberg
4,646,630 A 3/1987 McCoy et al.
4,761,305 A 8/1988 Ochiai
4,777,682 A 10/1988 Dreher et al.
4,784,666 A 11/1988 Brenner et al.
4,809,597 A 3/1989 Lin
4,879,887 A 11/1989 Kagi et al.
4,920,668 A 5/1990 Henneberger et al.
4,987,627 A 1/1991 Cur et al.
4,991,545 A 2/1991 Rabe et al.
5,032,186 A 7/1991 Childers et al.
5,050,259 A 9/1991 Tsubaki et al.
5,052,344 A 10/1991 Kosugi et al.
5,058,194 A 10/1991 Violi
5,063,609 A 11/1991 Lorimer
5,107,606 A 4/1992 Tsubaki et al.
5,146,693 A 9/1992 Dottor et al.
5,152,252 A 10/1992 Bolton et al.
5,154,197 A 10/1992 Auld et al.
5,172,654 A 12/1992 Christiansen
5,172,888 A 12/1992 Ezekoye
5,199,455 A 4/1993 Dlouhy
5,212,969 A 5/1993 Tsubaki et al.
5,219,370 A 6/1993 Farrington et al.
5,219,371 A 6/1993 Shim et al.
5,279,676 A 1/1994 Oslin et al.
5,291,758 A 3/1994 Lee
5,293,761 A 3/1994 Jang
5,315,727 A 5/1994 Lee
5,345,637 A 9/1994 Pastryk et al.
5,460,161 A 10/1995 Englehart et al.
5,570,626 A 11/1996 Vos
5,619,983 A 4/1997 Smith
5,727,402 A 3/1998 Wada
5,732,664 A 3/1998 Badeaux, Jr.
5,743,034 A 4/1998 Debourg et al.
5,758,377 A 6/1998 Cimetta et al.
5,768,730 A 6/1998 Matsumoto et al.
5,774,627 A 6/1998 Jackson
5,815,637 A 9/1998 Allen et al.
6,029,300 A 2/2000 Kawaguchi et al.
6,067,403 A 5/2000 Morgandi
6,094,523 A 7/2000 Zelina et al.
6,122,849 A 9/2000 Kida et al.
6,161,306 A 12/2000 Clodic
6,178,671 B1 1/2001 Zwanenburg et al.
6,295,691 B1 10/2001 Chen
6,327,730 B1 12/2001 Corbett
6,434,857 B1 8/2002 Anderson et al.
6,451,066 B2 9/2002 Estes et al.
6,460,381 B1 10/2002 Yoshida et al.
6,585,781 B1 7/2003 Roseen
6,622,529 B1 9/2003 Crane
6,647,931 B1 11/2003 Morgandi et al.
6,691,536 B2 2/2004 Severns et al.
6,772,751 B2 8/2004 Deuringer et al.
6,789,404 B2 9/2004 Kim et al.
6,823,878 B1 11/2004 Gadini
6,874,191 B2 4/2005 Kim et al.
6,889,399 B2 5/2005 Steiner et al.
7,021,087 B2 4/2006 France et al.
7,096,828 B2 8/2006 Tippmann
7,290,412 B2 11/2007 Yang et al.
7,325,330 B2 2/2008 Kim et al.
7,404,304 B2 7/2008 Yang et al.
7,421,752 B2 9/2008 Donadon et al.
7,476,369 B2 1/2009 Yin et al.
7,490,491 B2 2/2009 Yang et al.
7,490,493 B2 2/2009 Kim et al.
7,520,146 B2 4/2009 Kim et al.
7,600,402 B2 10/2009 Shin et al.
7,765,628 B2 8/2010 Wong et al.
2001/0032599 A1 10/2001 Fischer et al.
2003/0215226 A1 11/2003 Nomura et al.
2003/0226999 A1 12/2003 Hage
2004/0163184 A1 8/2004 Waldron et al.
2004/0187527 A1 9/2004 Kim et al.
2004/0187529 A1 9/2004 Kim et al.
2004/0200093 A1 10/2004 Wunderlin et al.
2004/0206480 A1 10/2004 Maydanik et al.
2004/0221474 A1 11/2004 Slutsky et al.
2004/0237603 A1 12/2004 Kim et al.
2004/0244432 A1 12/2004 Kim et al.
2004/0244438 A1 12/2004 North
2004/0255391 A1 12/2004 Kim et al.
2005/0000031 A1 1/2005 Price et al.
2005/0028297 A1 2/2005 Kim et al.
2005/0034248 A1 2/2005 Oh et al.
2005/0034249 A1 2/2005 Oh et al.
2005/0034250 A1 2/2005 Oh et al.
2005/0034487 A1 2/2005 Oh et al.
2005/0034488 A1 2/2005 Oh et al.
2005/0034489 A1 2/2005 Oh et al.
2005/0034490 A1 2/2005 Oh et al.
2005/0050644 A1 3/2005 Severns et al.
2005/0072382 A1 4/2005 Tippmann, Sr.
2005/0072383 A1 4/2005 Powell et al.
2005/0092035 A1 5/2005 Shin et al.
2005/0132503 A1 6/2005 Yang et al.
2005/0132504 A1 6/2005 Yang et al.
2005/0132756 A1 6/2005 Yang et al.
2005/0144734 A1 7/2005 Yang et al.
2005/0144735 A1 7/2005 Yang et al.
2005/0205482 A1 9/2005 Gladney
2005/0220672 A1 10/2005 Takahashi et al.
2005/0223503 A1 10/2005 Hong et al.
2005/0223504 A1 10/2005 Lee et al.
2005/0252250 A1 11/2005 Oh et al.
2005/0262644 A1 12/2005 Oak et al.
2005/0284194 A1* 12/2005 Kim et al. ..... 68/17 R
2006/0000242 A1 1/2006 Yang et al.
2006/0001612 A1 1/2006 Kim
2006/0005581 A1 1/2006 Banba
2006/0010613 A1 1/2006 Jeon et al.
2006/0010727 A1 1/2006 Fung
2006/0010937 A1 1/2006 Kim et al.
2006/0016020 A1 1/2006 Park
2006/0090524 A1 5/2006 Jeon et al.
2006/0096333 A1 5/2006 Park et al.
2006/0101586 A1 5/2006 Park et al.
2006/0101588 A1 5/2006 Park et al.
2006/0101867 A1 5/2006 Kleker
2006/0107468 A1 5/2006 Urbanet et al.
2006/0112585 A1 6/2006 Choi et al.
2006/0117596 A1 6/2006 Kim et al.
2006/0130354 A1 6/2006 Choi et al.
2006/0137105 A1 6/2006 Hong et al.
2006/0137107 A1 6/2006 Lee et al.
2006/0150689 A1 7/2006 Kim et al.
2006/0151005 A1 7/2006 Kim et al.

(56) References Cited

U.S. PATENT DOCUMENTS

| | | | |
|---|---|---|---|
| 2006/0151009 | A1 | 7/2006 | Kim et al. |
| 2006/0191077 | A1 | 8/2006 | Oh et al. |
| 2006/0191078 | A1 | 8/2006 | Kim et al. |
| 2006/0277690 | A1 | 12/2006 | Pyo et al. |
| 2007/0006484 | A1 | 1/2007 | Moschuetz et al. |
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0130698 | A1 | 6/2007 | Kim |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | A1 | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | A1 | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1555339 | | 8/2007 |
| EP | 1813704 | A1 | 8/2007 |
| EP | 1813709 | A2 | 8/2007 |

(56) References Cited

FOREIGN PATENT DOCUMENTS

| | | | |
|---|---|---|---|
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | | 11/1986 |
| FR | 2688807 | A1 | 9/1993 |
| GB | 10423 | | 0/1909 |
| GB | 21024 | | 0/1910 |
| GB | 21286 | | 0/1898 |
| GB | 191010567 | A | 4/1911 |
| GB | 191010792 | A | 4/1911 |
| GB | 191022943 | A | 8/1911 |
| GB | 191024005 | A | 10/1911 |
| GB | 191103554 | A | 12/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | | 5/1994 |
| JP | 08261689 | | 10/1996 |
| JP | 9133305 | A | 5/1997 |
| JP | 10235088 | A | 9/1998 |
| JP | 11047488 | | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | A | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | A | 4/2006 |
| WO | 9214954 | | 9/1992 |
| WO | 9307798 | A1 | 4/1993 |
| WO | 9319237 | A1 | 9/1993 |
| WO | 9715709 | | 5/1997 |
| WO | 9803175 | | 1/1998 |
| WO | 0111134 | | 2/2001 |
| WO | 0174129 | A2 | 10/2001 |
| WO | 03012185 | | 2/2003 |
| WO | 03012185 | A2 | 2/2003 |
| WO | 03057966 | | 7/2003 |
| WO | 2004059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |

(56) References Cited

FOREIGN PATENT DOCUMENTS

| | | | |
|---|---|---|---|
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

FABRIC TREATMENT APPLIANCE WITH STEAM BACKFLOW DEVICE

CROSS-REFERENCE TO RELATED APPLICATIONS

This is a continuation-in-part of U.S. patent application Ser. No. 11/464,501, a continuation-in-part of U.S patent application Ser. No. 11/464,506, a continuation-in-part of U.S. patent application Ser. No. 11/464,520, and a continuation-in-part of U.S. patent application Ser. No. 11/464,521, all filed Aug. 15, 2006.

BACKGROUND OF THE INVENTION

1. Field of the Invention

The invention relates to a fabric treatment appliance, such as a washing machine, with a steam generator.

2. Description of the Related Art

Some fabric treatment appliances, such as a washing machine, a clothes dryer, and a fabric refreshing or revitalizing machine, use steam generators for various reasons. The steam from the steam generator can be used to, for example, heat water, heat a load of fabric items and any water absorbed by the fabric items, dewrinkle fabric items, remove odors from fabric items, sanitize the fabric items, and sanitize components of the fabric treatment appliance.

Water from a water supply coupled to the steam generator typically provides water to the steam generator for conversion to steam. Steam generated in the steam generator commonly flows from the steam generator to a fabric treatment chamber via a steam supply conduit. If flow out of the steam generator or flow through the steam supply conduit becomes impaired, such as due to buildup of scale, steam from the steam generator can undesirably flow in a reverse direction to the water supply.

SUMMARY OF THE INVENTION

A fabric treatment appliance according to one embodiment of the invention comprises a receptacle defining a fabric treatment chamber for receiving laundry, a steam generator having an inlet for receiving water from a water supply and an outlet for supplying steam to the fabric treatment chamber, and a liquid trap upstream from the steam generation chamber blocking backflow of steam from the steam generation chamber to the water supply conduit.

DESCRIPTION OF EMBODIMENTS OF THE INVENTION

Figure 1:
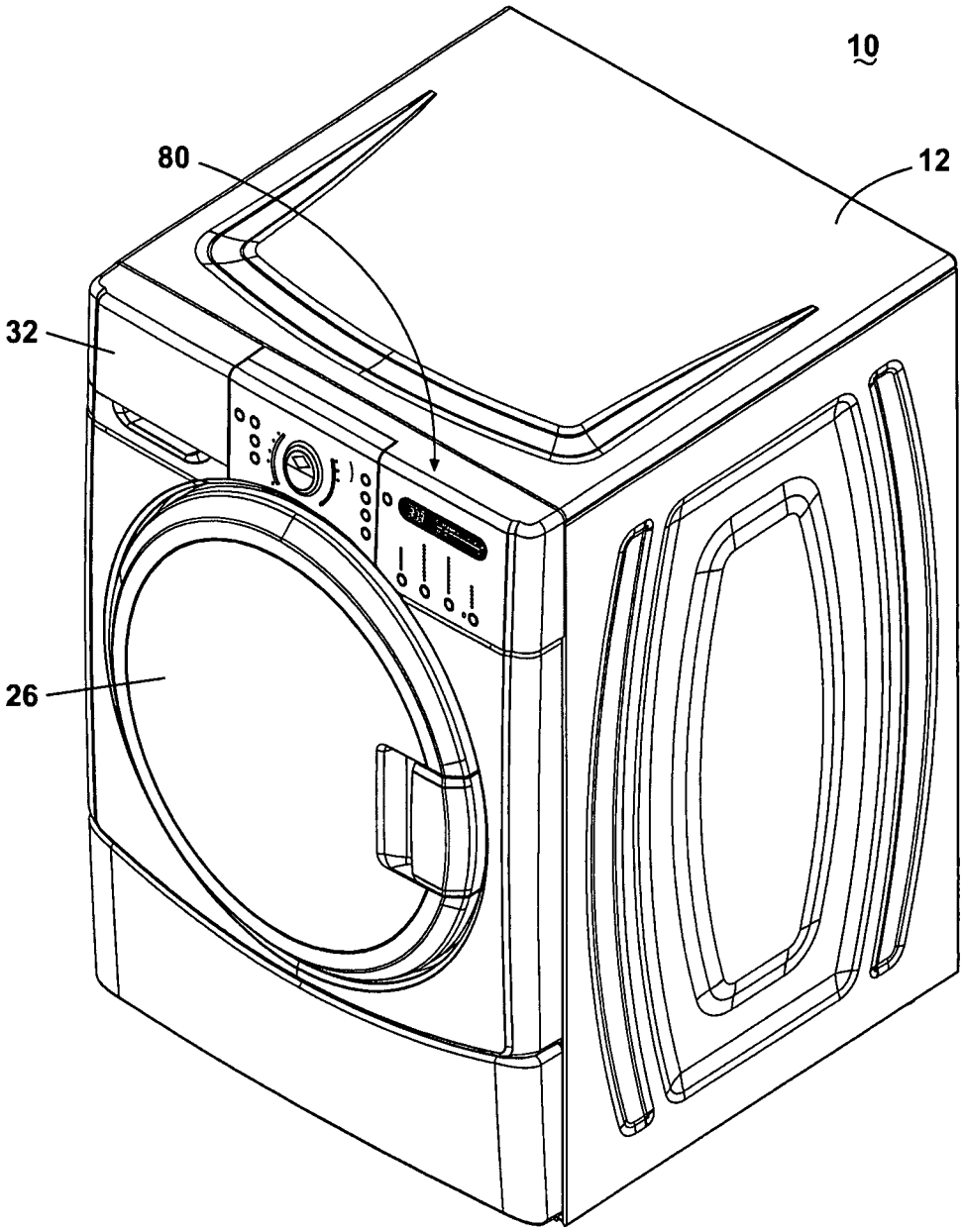
FIG. 1 is a perspective view of an exemplary fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, irons, and cooking appliances, including ovens, food steamers, and microwave ovens, employing a steam generator.

Figure 2:
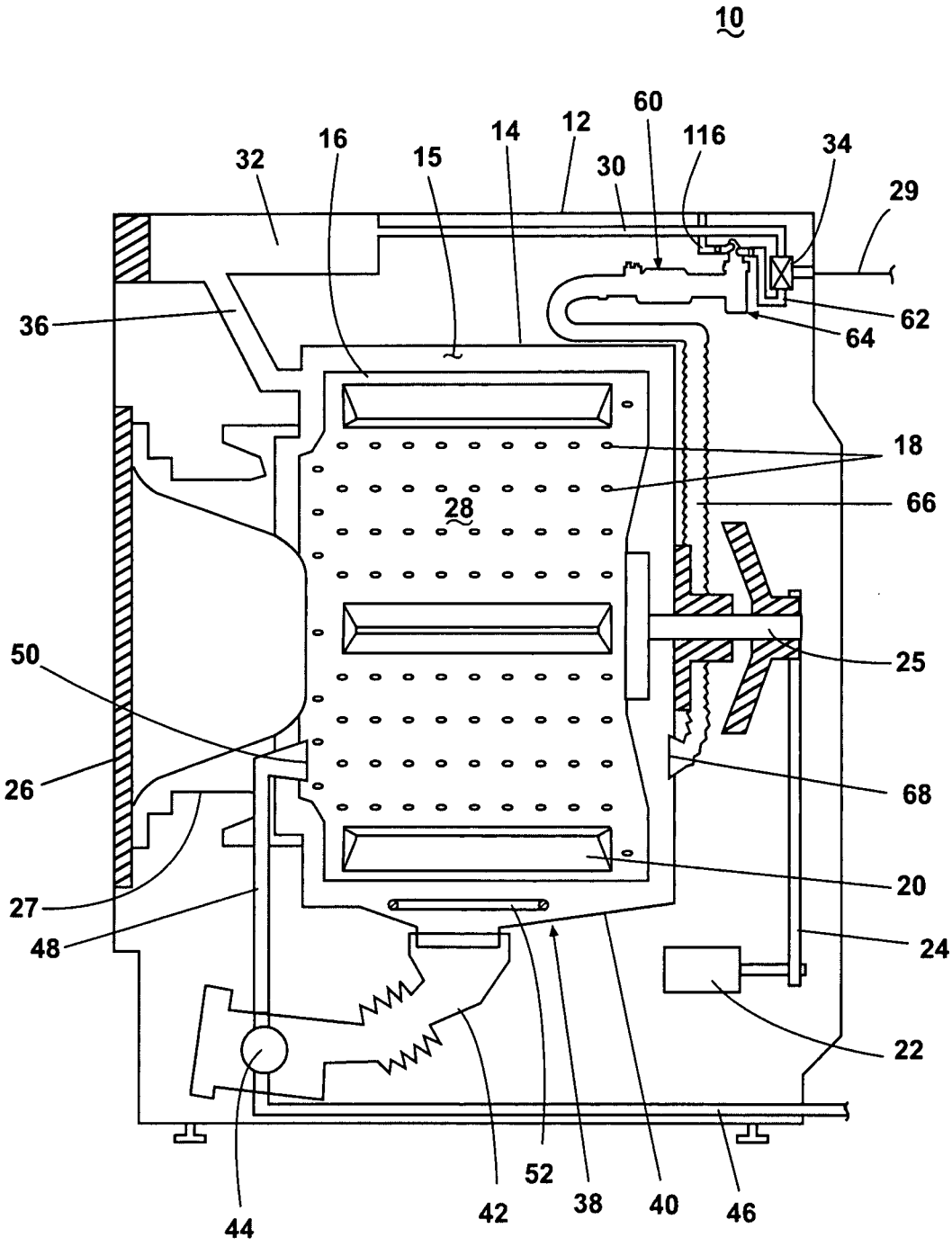
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates. A motor 22 coupled to the drum 16 through a belt 24 and a drive shaft 25 may rotate the drum 16. Alternately, the motor 22 may be directly coupled with the drive shaft 25. Both the tub 14 and the drum 16 may be selectively closed by a door 26. A bellows 27 couples an open face of the tub 14 with the cabinet 12, and the door 26 seals against the bellows 27 when the door 26 closes the tub 14. The drum 16 may define a cleaning chamber 28 for receiving fabric items to be cleaned.

The tub 14 and/or the drum 16 may individually or collectively be considered a receptacle, and the receptacle may define a treatment chamber for receiving fabric items to be treated. While the illustrated washing machine 10 includes both the tub 14 and the drum 16, it is within the scope of the invention for the fabric treatment appliance to include only one receptacle, with the receptacle defining the treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis, relative to a surface that supports the washing machine. Typically the drum is perforate or imperforate, and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, and holds fabric items and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum. The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1 G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a water supply 29, such as a household water supply. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 typically enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62 via a reservoir 64. The inlet valve 34 may control flow of the liquid from the water supply 29 and through the second supply conduit 62 and the reservoir 64 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

An optional sump heater 52 may be located in the sump 38. The sump heater 52 may be any type of heater and is illustrated as a resistive heating element for exemplary purposes. The sump heater 52 may be used alone or in combination with the steam generator 60 to add heat to the chamber 15. Typically, the sump heater 52 adds heat to the chamber 15 by heating water in the sump 38.

The washing machine 10 may further include an exhaust conduit (not shown) that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, titled "Fabric Treating Appliance Utilizing Steam," U.S. patent application Ser. No. 11/464,501, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may utilize the sump heater 52 or other heating device located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, titled "Water Supply Control for a Steam Generator of a Fabric Treatment Appliance," U.S. patent application Ser. No. 11/464,514, titled "Water Supply Control for a Steam Generator of a Fabric Treatment Appliance Using a Weight Sensor," and U.S. patent application Ser. No. 11/464,513, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces hot water. The hot water may be delivered to the tub 14 and/or drum 16 from the steam generator 60. The hot water may be used alone or may optionally mix with cold or warm water in the tub 14 and/or drum 16. Using the steam generator 60 to produce hot water may be useful when the steam generator 60 couples only with a cold water source of the water supply 29. Optionally, the steam generator 60 may be employed to simultaneously supply steam and hot or warm water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, titled "Method of Operating a Washing Machine Using Steam;" U.S. patent application Ser. No. 11/450,529, titled "Steam Washing Machine Operation Method Having Dual Speed Spin Pre-Wash;" and U.S. patent application Ser. No. 11/450,620, titled "Steam Washing Machine Operation Method Having Dry Spin Pre-Wash," all filed Jun. 9, 2006, which are incorporated herein by reference in their entirety.

Figure 3:
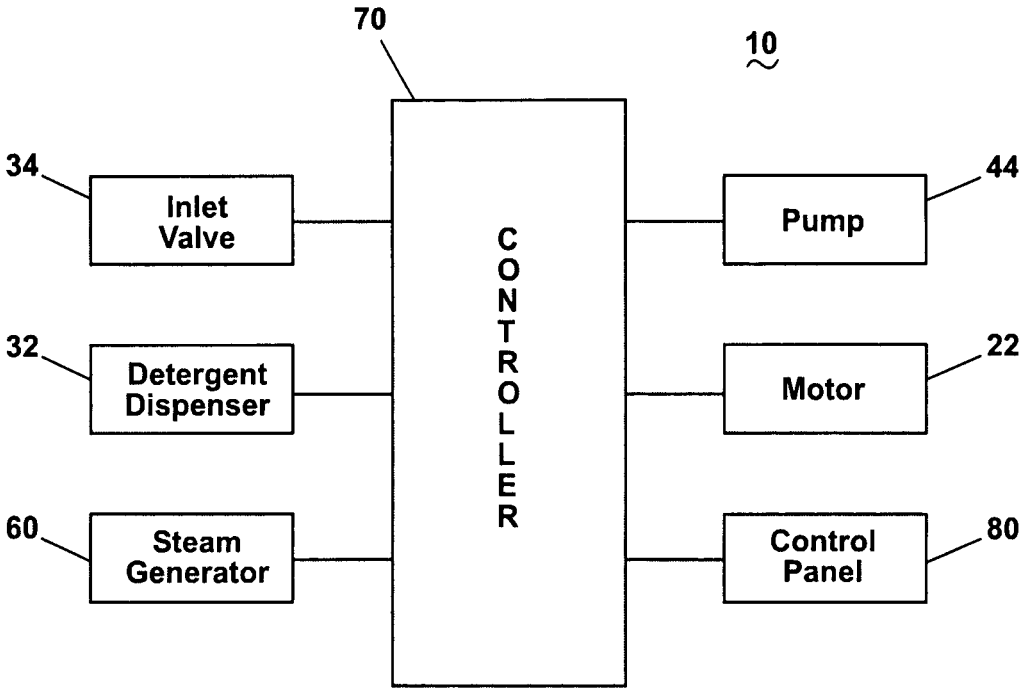
FIG. 3 is a schematic view of an exemplary control system of the fabric treatment appliance of FIG. 1.

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller 70 may receive data from one or more of the working components and may provide commands, which can be based on the received data, to one or more of the working components to execute a desired operation of the washing machine 10. The commands may be data and/or an electrical signal without data. A control panel 80 may be coupled to the controller 70 and may provide for input/output to/from the controller 70. In other words, the control panel 80 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various components (inlet valve 34, detergent dispenser 32, steam generator 60, pump 44, motor 22, and control panel 80) to effect the control software.

Figure 4:
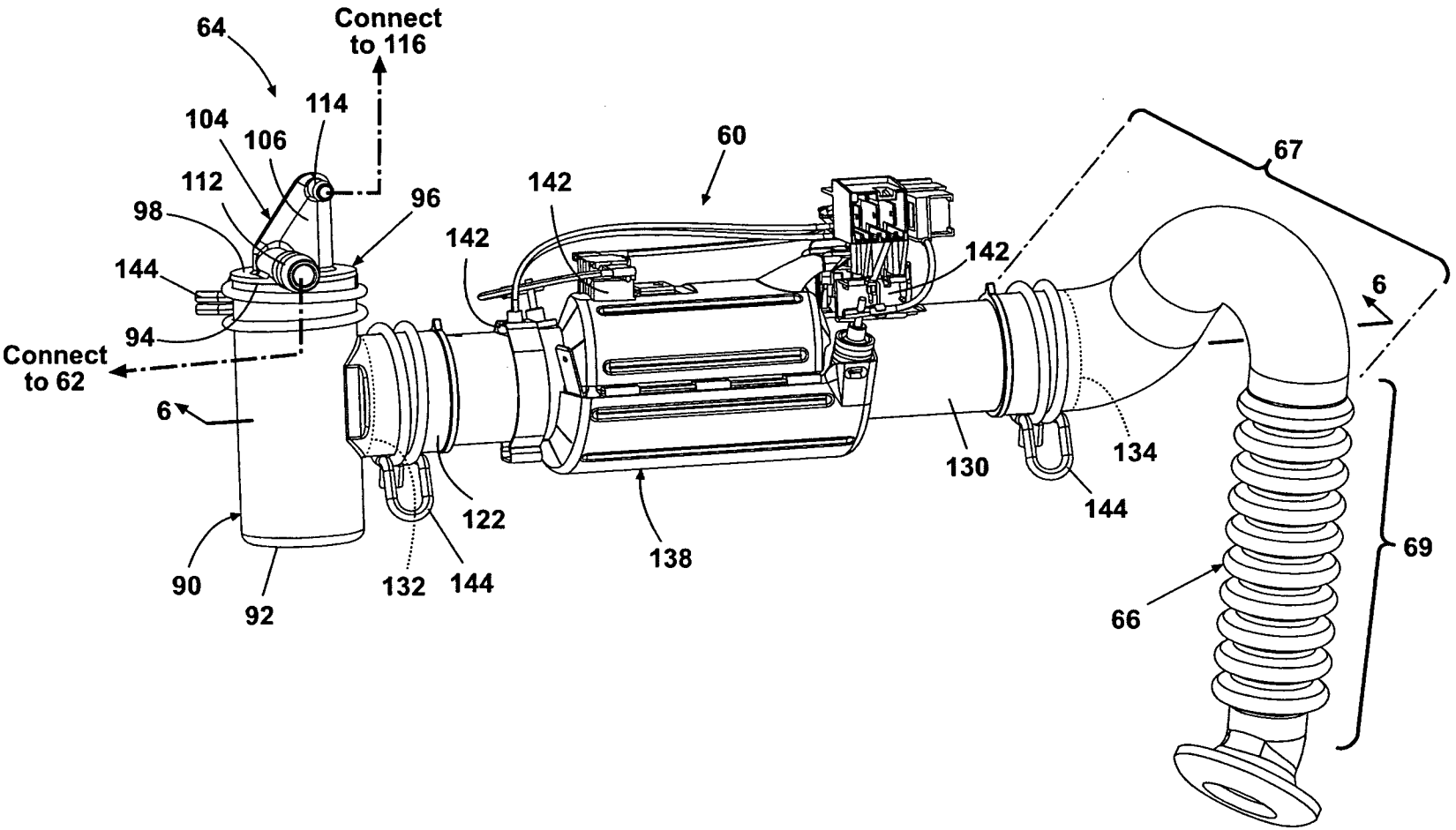
FIG. 4 is a perspective view of a steam generator, reservoir, and steam conduit from the fabric treatment appliance of FIG. 1.
Figure 5:
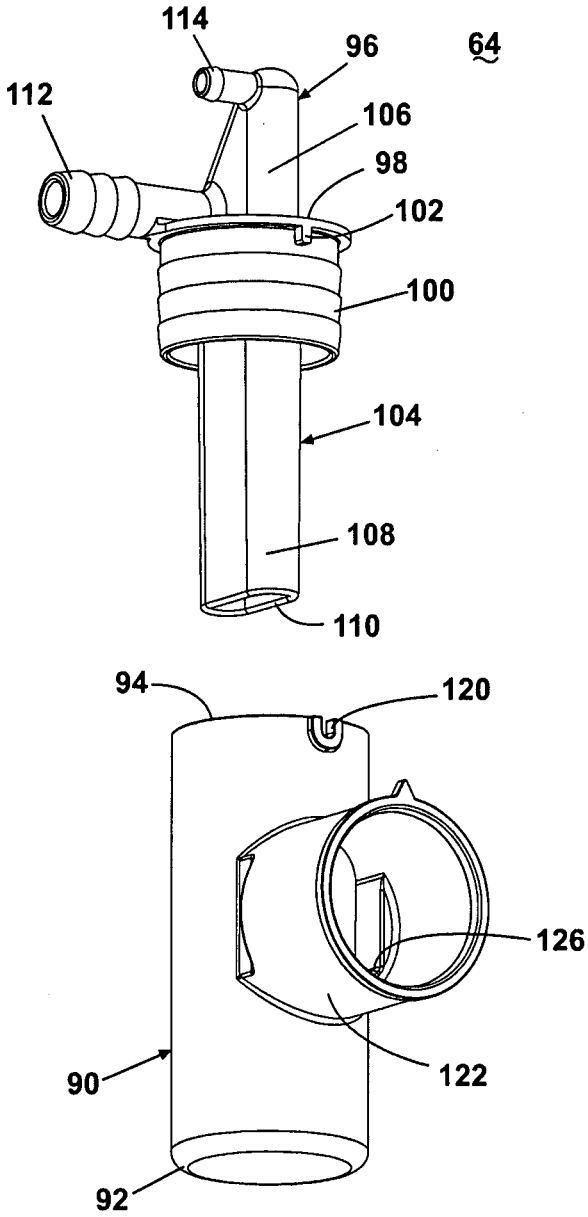
FIG. 5 is an exploded view of the reservoir of FIG. 4.

FIG. 4 provides a perspective view of the reservoir 64, the steam generator 60, and the steam conduit 66. In general, the reservoir 64 is configured to receive water from the water supply 29, store a volume of water, and supply water to the steam generator 60. It performs multiple functions, including functioning as a liquid trap and as a siphon break. The stored volume of water functions as a liquid trap to prevent the backflow of steam from the steam generator 60 to the second supply conduit 62. In the exemplary embodiment, the reservoir 64 may include a generally cylindrical tank 90 having a closed bottom 92 and an open top 94 and a lid 96 removably closing the open top 94. As shown in FIG. 5, which is an exploded view of the reservoir 64, the lid 96 may have a circular, planar cap 98 with a depending, generally cylindrical body 100 sized for receipt through the open top 94 of the tank 90 and having a serrated outer surface and a tab 102 located on the outer surface adjacent the cap 98. A variety of other lid 96 configurations are also possible.

The reservoir 64 may include a water supply conduit 104 for supplying water from the water supply 29 to the tank 90. In the illustrated embodiment, the water supply conduit 104 may extend through the cap 98 such that an upper portion 106 resides above the cap 98 and a lower portion 108 resides below the cap 98 and extends through and below the cylindrical body 100. The lower portion 108 of the water supply conduit 104 may terminate at an outlet 110 positioned below the cylindrical body 100. The upper portion 106, which, as shown in the illustrated embodiment, may have a triangular configuration, a water supply inlet connector 112 disposed near the cap 98, and a siphon break connector 114 located at an upper end of the upper portion 106. The illustrated locations of the water supply inlet connector 112 and the siphon break connector 114 are provided for exemplary purposes; the water supply inlet connector 112 and the siphon break connector 114 can have any suitable location. The water supply inlet connector 112 may be coupled to the second water supply conduit 62 to receive water from the water supply 29 and provide the water to the water supply conduit 104. The siphon break connector 114 may be coupled to a siphon break conduit 116 (FIG. 2), which is coupled to atmospheric pressure, to form a siphon break device. The siphon break conduit 116 may be coupled to atmosphere external to the washing machine 10. The water supply inlet connector 112, the siphon break connector 114, and the outlet 110 of the water supply conduit 104 may be in fluid communication with one another. The exemplary water supply conduit 104 is illustrated as having a generally oblong transverse cross-section, but it is within the scope of the invention for the water supply conduit 104 to have any suitable configuration.

Figure 6:
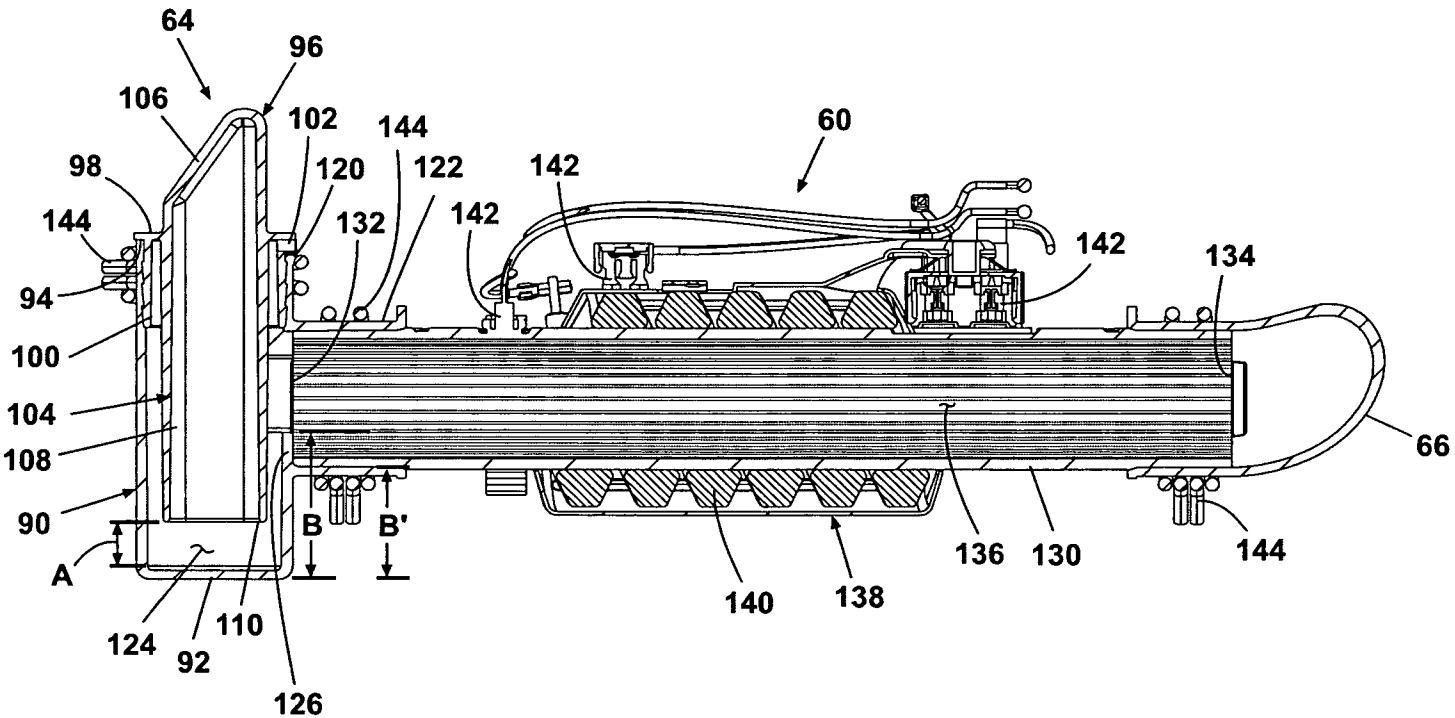
FIG. 6 is a sectional view taken along line 6-6 of FIG. 4.

With continued reference to FIG. 5, the tank 90 of the reservoir 64 may include a notch 120 at the open top 94 sized to receive the tab 102 of the lid 96, thereby facilitating alignment of the lid 96 on the tank 90. The reservoir 64 may further include a steam generator connector 122 for coupling the tank 90 to the steam generator 60 and supplying water from the tank 90 to the steam generator 60. In the illustrated embodiment, the steam generator connector 122, which may be generally cylindrical, may project laterally from the tank 90. As seen in FIG. 6, which is a sectional view of the reservoir 64, the steam generator 60, and the steam conduit 66, the steam generator connector 122 fluidly communicates the steam generator 60 with an interior or chamber 124 of the tank 90. An upstanding lip 126 may be located at a juncture between the tank 90 and the steam generator connector 122.

With continued reference to FIG. 6, while the steam generator 60 may be any type of steam generator, the exemplary steam generator 60 of the current embodiment is in the form of an in-line steam generator with a tube 130 having a first end 132 coupled to the steam generator connector 122 of the reservoir 64 and a second end 134 coupled to the steam conduit 66. The first end 132 may define an inlet to the steam generator 60, and the second end 134 may define an outlet for the steam generator 60. While the first end 132 may define the inlet to the steam generator 60, an effective inlet may be formed by the first end 132 in combination with the lip 126, which will be described in more detail below. The tube 130 may define a steam generation chamber 136 between the first end 132 and the second end 134, and a heat source 138 may be positioned relative to the tube 130 and the steam generation chamber 136 to provide heat to the tube 130 and the steam generation chamber 136. In the current embodiment, the heat source 138 includes a resistive heater 140 coiled around the tube 130 in a generally central location relative to the first and second ends 132, 134. The steam generator 60 may have temperature sensors 142 associated with the tube 130 and/or the heat source 138 and in communication with the controller 70 for operation of the heat source 138 and/or supply of water to the steam generator 60. Clamps 144 may be employed to secure the steam generator tube 130 to the steam generator connector 122 of the reservoir 64 and to the steam conduit 66 and to secure the reservoir lid 96 to the tank 90.

The first end 132 of the steam generator tube 130 may be coupled to the reservoir 64 via the steam generator connector 122 for receiving water from the water supply conduit 104. In general, the outlet 110 of the water supply conduit 104 will be lower than the inlet to the steam generator 60, which may correspond to the actual inlet to the steam generator 60 or an effective inlet to the steam generator 60. For example, the actual inlet to the steam generator may be formed by the first end 132 of the steam generator tube 130, while the lip 126 and the first end 132 may form an effective inlet to the steam generator 60 as the lip 126 alters the inlet to the steam generator 60. In the exemplary embodiment, the lower portion 108 of the water supply conduit 104 may be received by the tank 90 with the outlet 110 disposed a distance A above the bottom 92 of the tank 90, and the distance A may be any suitable distance less than a distance B between an upper end of the lip 126 and the bottom 92 of the tank 90. Absent the lip 126, the distance A may be any suitable distance less than a distance B' between the steam generator connector 122 and the bottom of the tank 90.

If the outlet 110 is lower than the inlet or effective inlet to the steam generator 60 then a water plug may form between the outlet 110 and the inlet or effective inlet to the steam generator 60, with the water plug functioning as a water trap preventing steam in the steam generator tube 130 from backflowing into the water supply conduit 104. In the illustrated embodiment, a volume of the tank chamber 124 between the steam generator inlet or effective inlet and the tank bottom 92 may be filled with water from the water supply conduit 104 to form the water plug. In fact, the water plug need not reach the inlet or effective inlet to the steam generator 60 as long as the outlet 110 is positioned in the water plug (i.e., the water plug may have a height between the outlet 110 and the inlet or effective inlet to the steam generator 60). The positioning of the outlet 110 in the water plug precludes steam from flowing upstream from the steam generation chamber 136, through the water supply conduit outlet 110, and to the water supply 29. The water plug is discussed further below with respect to the operation of the washing machine 10, particularly the operation of the steam generator 60.

The reservoir 64 and the steam generator 60 may be positioned with the reservoir 64 at the steam generator inlet, as illustrated in FIG. 6, or, alternatively, the reservoir 64 and the steam generator 60 may be spaced from one another and coupled by a conduit. In either case, positioning the reservoir 64 upstream from the steam generator inlet so that the water plug may be formed in the reservoir prevents backflow of steam from the steam generator 60.

The reservoir 64 and the steam generator 60 may be oriented such that they are generally perpendicular to one another, as illustrated in FIG. 6, or in another suitable orientation so that the water plug may be formed between the water supply conduit outlet 110 and the steam generator inlet to prevent backflow of steam from the steam generator 60 to the water supply 29. Further, the water supply conduit 104 may be oriented in a generally vertical position, as illustrated in FIG. 6, or in another suitable position at an angle relative to horizontal such that the water plug cannot drain through the water supply conduit 104 by gravity.

The steam generator 60 may be employed for steam generation during operation of the washing machine 10, such as during a wash operation cycle, which can include prewash, wash, rinse, and spin steps, during a washing machine cleaning operation cycle to remove or reduce biofilm and other undesirable substances, like microbial bacteria and fungi, from the washing machine, during a refresh or dewrinkle operation cycle, or during any other type of operation cycle. The steam generator may also be employed for generating heated water during operation of the washing machine 10.

Figure 7A:
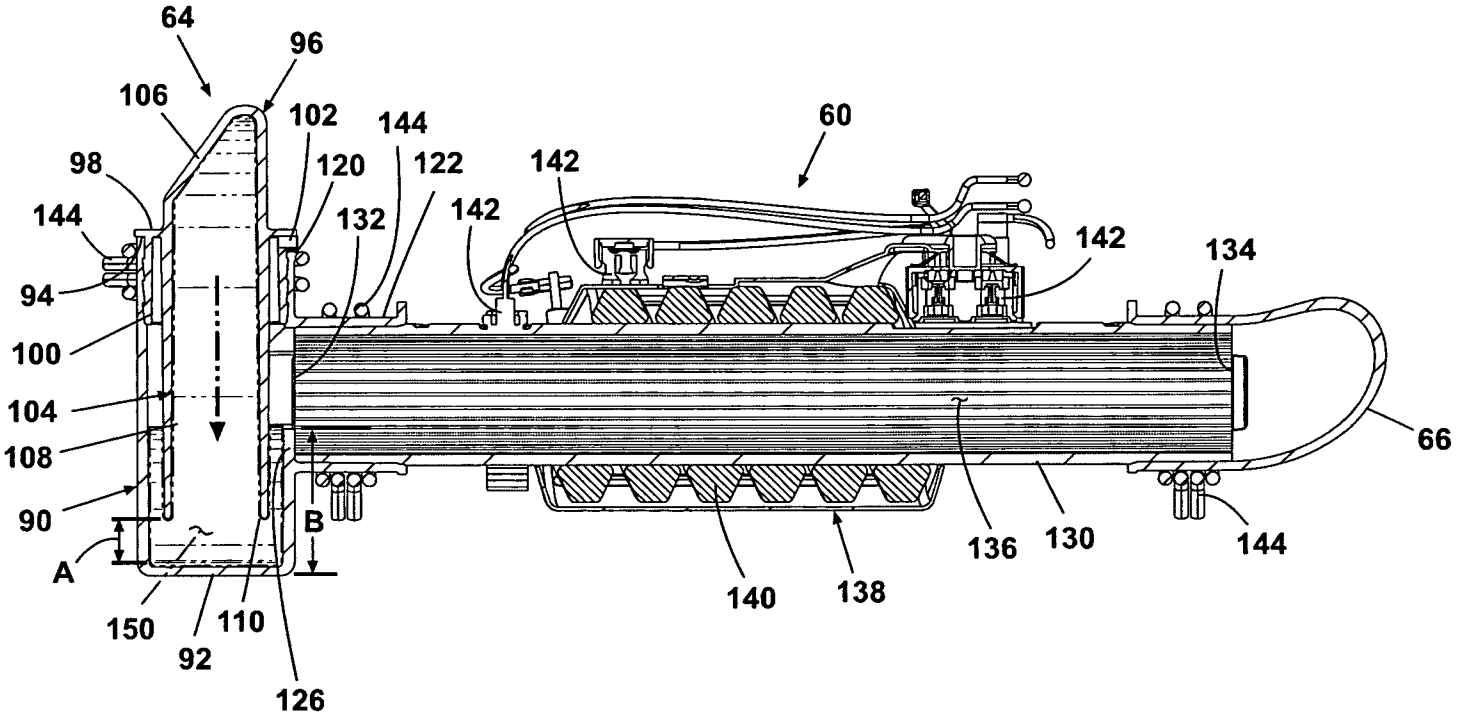
FIGS. 7A-7D are sectional views similar to FIG. 6 showing varying water levels in the reservoir and the steam generator according to one embodiment of the invention.
Figure 7B:
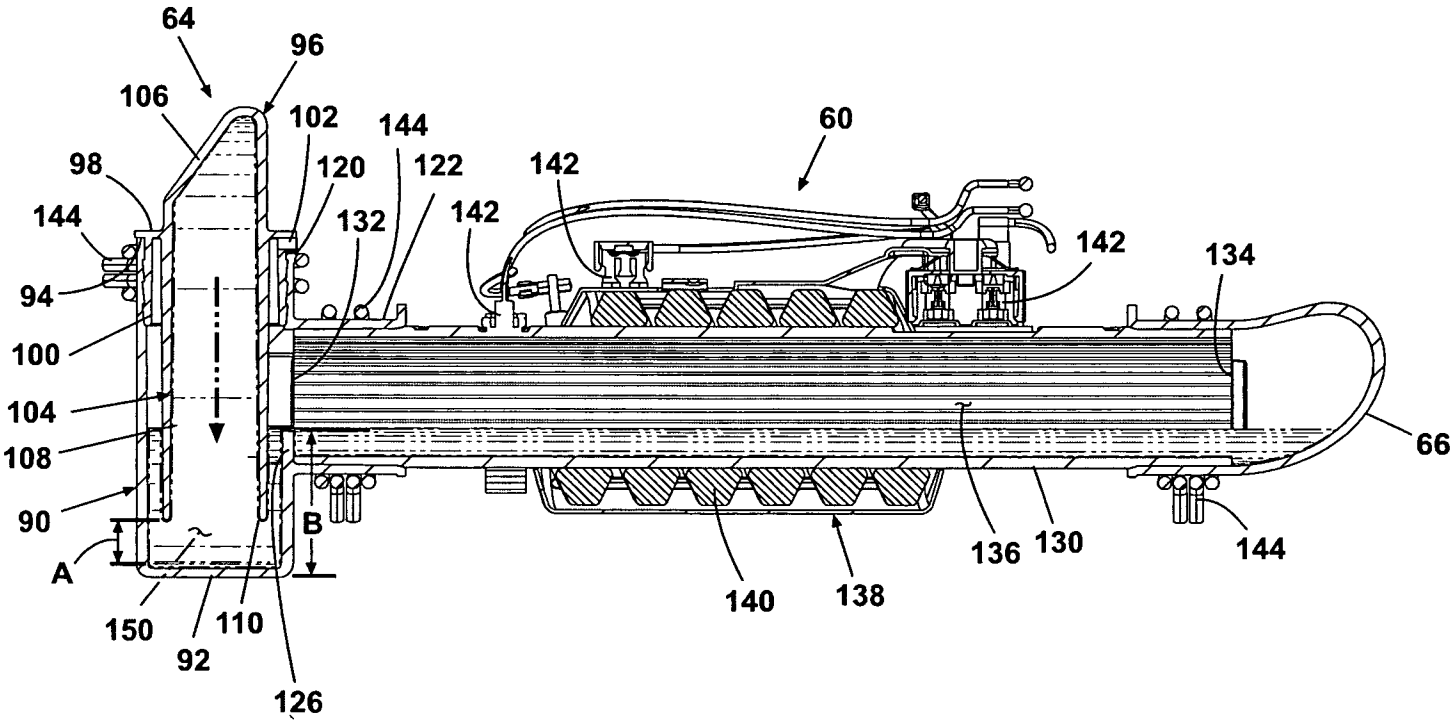
Figure 7C:
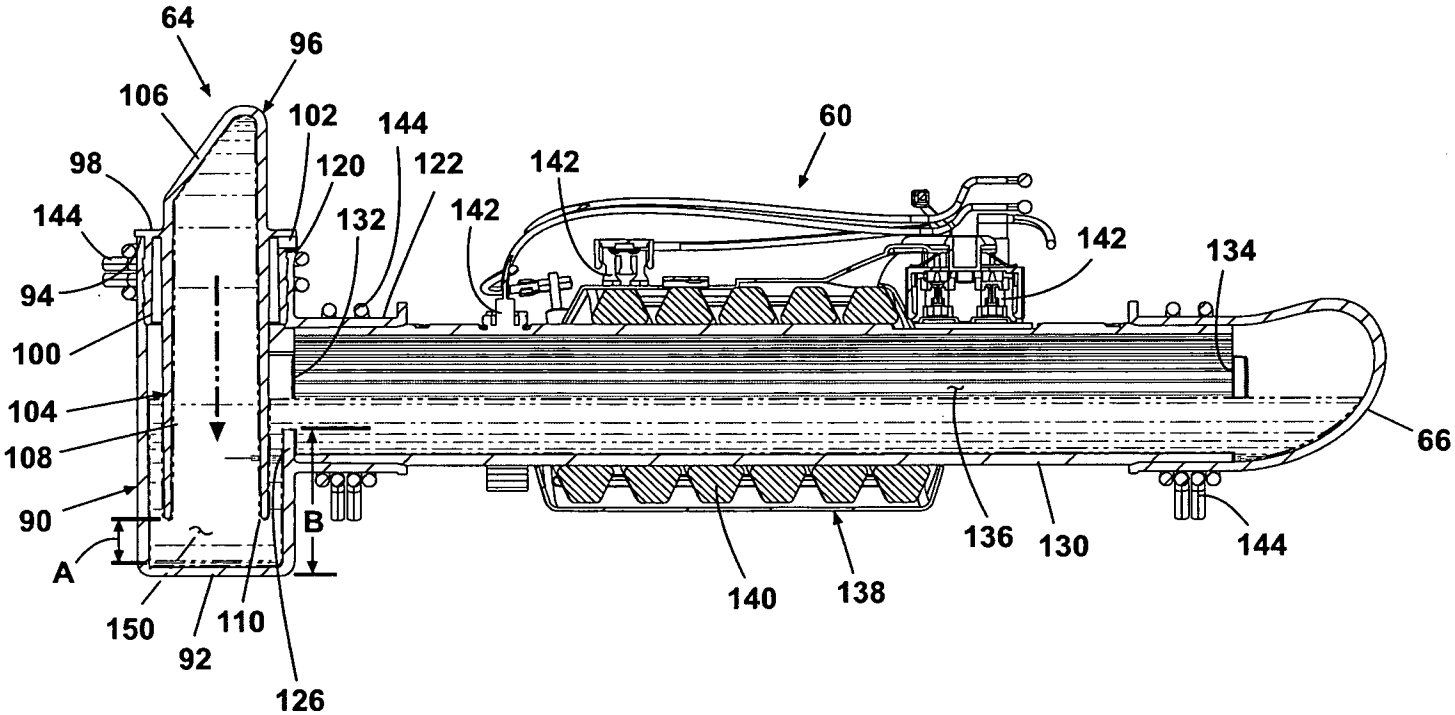
Figure 7D:
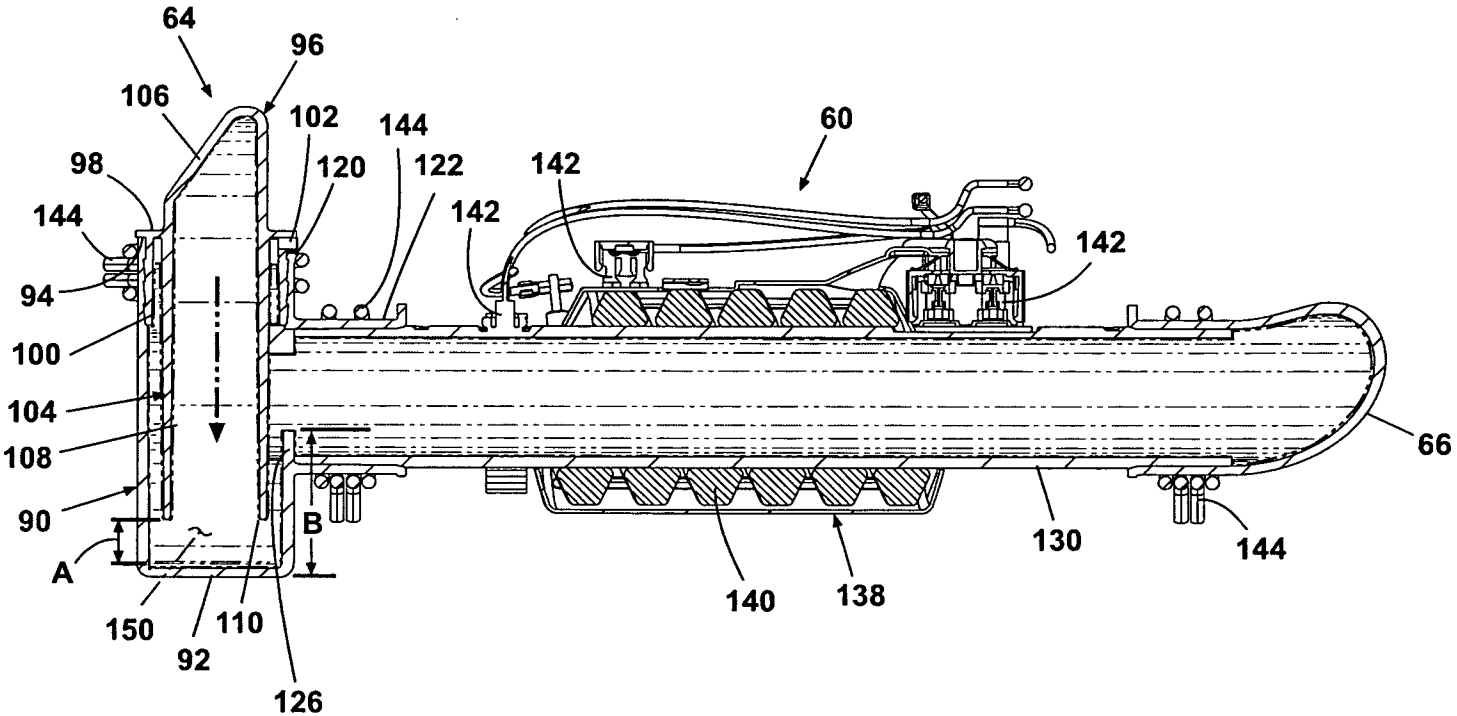

To operate the steam generator 60, water from the water supply 29 may be provided to the steam generator 60 via the valve 34, the second supply conduit 62, the water supply conduit 104, and the tank 90. As illustrated in FIG. 7A, which is a sectional view similar to FIG. 6 showing water supply to a level corresponding to the water plug 150, water that enters the tank chamber 124 from the water supply conduit 104, as indicated by the arrow in the water supply conduit 104, fills the volume of the tank chamber 124 between the steam generator inlet or effective inlet and the tank bottom 92 to thereby form the water plug 150. As discussed above, the water plug 150 may have any suitable height greater than the height of the water supply conduit outlet 110 and need not reach the steam generator inlet or effective inlet. Once the water reaches the steam generator inlet or, in the illustrated embodiment, the effective inlet formed by the lip 126 and the first end 132 of the steam generator tube 130, the water flows into the steam generator tube 130 and begins to fill the steam generation chamber 136 and, depending on the configuration of the steam generator 60 and the steam conduit 66, possibly a portion of the steam conduit 66. In the exemplary embodiment, the water that initially enters the steam generation chamber 136 fills the steam generation chamber 136 and the steam conduit 66 to a level corresponding to the water plug 150 without a coincident rise in the water level in the tank 90, as illustrated by example in FIG. 7B due to the effective inlet formed by the lip 126 and the first end 132 of the steam generator tube 130. Once the water fills the steam generation chamber 136 to the level corresponding to the water plug 150, further supply of water from the water supply conduit 104 causes the water levels in the tank 90 and the steam generation chamber 136 to rise together as a single water level, as illustrated in FIG. 7C. If the steam generation chamber 136 becomes completely filled with water, further supply of water from the water supply conduit 104 causes the water level in the tank 90 to further rise, as illustrated in FIG. 7D.

Referring back to FIG. 4, to prevent water supplied to the steam generator 60 from flowing directly out of the steam generator 60 to the tub 14, the steam conduit 66 of the illustrated embodiment has a gooseneck portion 67 that transitions into an articulated portion 69. The gooseneck portion 67 extends above the second end 134 of the steam generator tube 130 and aids in retarding the immediate passing of water out of the steam generator tube 130 upon filling. The articulated portion 69 provides for axial extension/contraction for ease of coupling the steam generator 60 to the tub 14.

Referring back to FIG. 7C, at any desired time, the heat source 138 may be activated to generate heat to convert the water in the steam generation chamber 136 to steam. For example, the heat source 138 may be activated prior to, during, or after the supply of water. Steam generated in the steam generation chamber 136 flows from the steam generator tube 130 and through the steam conduit 66 to the treatment chamber. In some circumstances, such as, for example, excessive scale formation or formation of other blockage in the steam generator 60 or the steam conduit 66, the steam may attempt to flow upstream to the water supply 29 rather than to the treatment chamber. However, the water plug 150 between the steam generator inlet or effective inlet and the outlet 110 of the water supply conduit 104 blocks steam from flowing from the steam generation chamber 136 backwards into the water supply conduit 104 and to the water supply 29. In other words, no flow path exists for the steam to flow upstream from the steam generation chamber 136 to the water supply 29 as the water plug 150 blocks the steam from entering the water supply conduit 104 through the outlet 110. Even if the water in the steam generation chamber 136 becomes depleted, the water plug 150 remains in the tank 90 due to the relative positioning of the water supply conduit outlet 110 and the inlet or effective inlet to the steam generation chamber 136.

In the embodiment shown, because of the lip 126, the water level in the tank 90 will not drop below the water level corresponding to the water plug 150 if the water level in the steam generation chamber 136 falls below that of the water plug 150, including depletion of the water in the steam generation chamber 136. Water can be resupplied to the steam generation chamber 136 at any suitable time during the operation of the steam generator 60. Optionally, the reservoir 64 may include a drain for draining the water plug 150, such as following operation of the steam generator 60. The lip 126 also functions as a baffle that retards deposits in the water from flowing back into the tank chamber 124, which might then interfere with the flow of water though the lower portion 108 as the deposits collect in the bottom 92 of the tank 90.

During the operation of the washing machine 10, the siphon break device may prevent water or other liquids from the tub 14 and/or the drum 16 from undesirably flowing to the water supply 29 via the steam generator 60. Any siphoned liquids may flow through the steam generator 60, into the reservoir 64, through the water supply conduit 104, and through the siphon break conduit 116 (FIG. 2) to the atmosphere external to the washing machine 10 or other suitable location. The siphoned liquids may flow through the siphon break conduit 116 rather than through the second supply conduit 62 to the water supply 29. This type of siphon break device is commonly known as an air-gap siphon break, but it is within the scope of the invention for any type of siphon break device to be coupled to the reservoir 64. Further, it is also within the scope of the invention for the siphon break device to be separate from the reservoir 64 or for the reservoir 64 to be employed without the siphon break device.

The term "water plug" has been employed to describe the volume of water physically located between the water supply conduit outlet 110 and the inlet or effective inlet to the steam generator 60. The term "water plug" is descriptive in the sense that the water fills the space between the water supply conduit outlet 110 and the inlet or effective inlet to the steam generator 60 to block backflow of steam, much like a conventional plug fills a space. Other connotations associated with "plug" are not necessarily intended to be attributed to the "water plug" of the current invention. For example, one connotation associated with a plug may be that a plug permanently fills a space. Indeed, the water plug may be designed as having a volume that may provide sufficient resistance to an upper limit of pressure applied by steam such that the steam cannot push or force the water in the water plug to flow upstream through the water supply conduit 104. Alternatively, the water plug may have a volume corresponding to a predetermined threshold of steam pressure such that steam of the predetermined threshold of steam pressure may push or force the water in the water plug to flow upstream through the water supply conduit 104.

Figure 8:
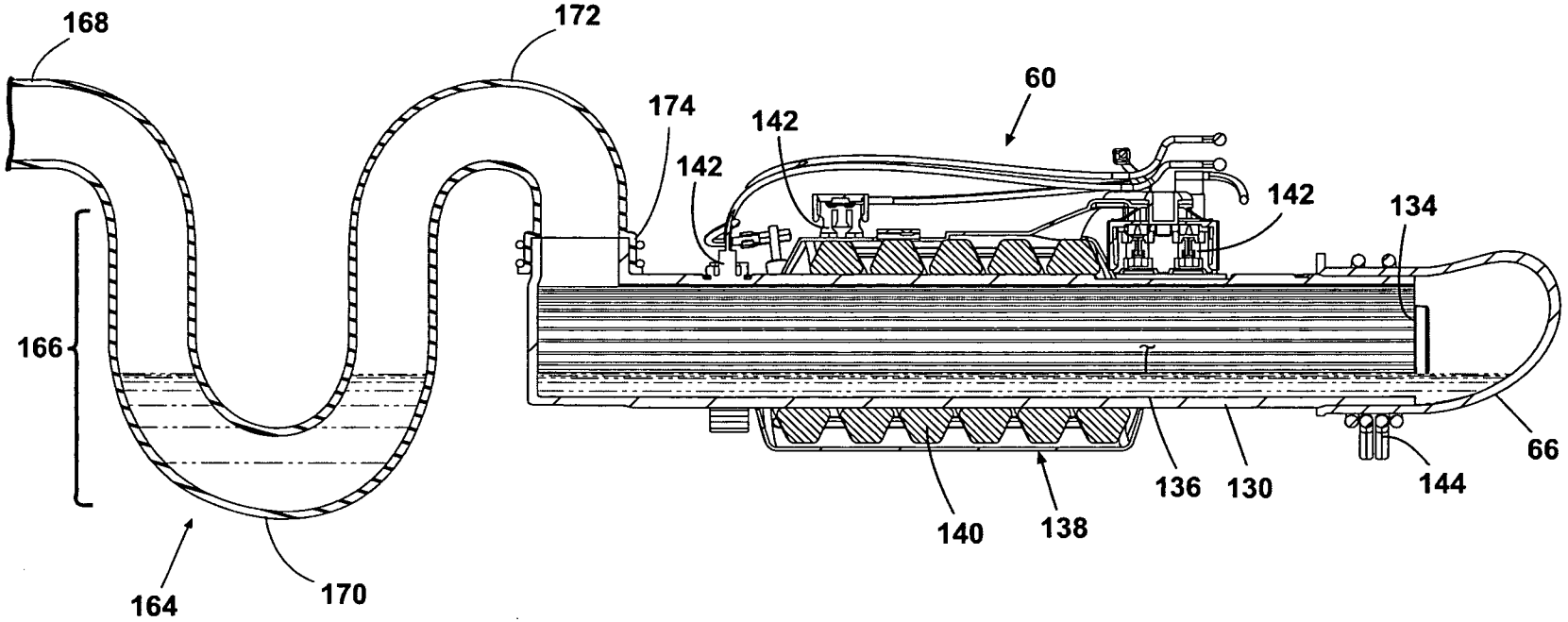
FIG. 8 illustrates a second embodiment of the reservoir according to the invention.

FIG. 8 illustrates a second embodiment of the liquid trap and steam generator. The second embodiment is identical to the first embodiment except that the reservoir 64 is replaced with a conduit 168 to form a liquid trap 164 and the first end 132 of the steam generator tube 130 is closed. The liquid trap 164 is connected to the second supply conduit 62 on one end and the steam generator tube 130 on the other end. The liquid trap 164 has a trap portion 166 located beneath the steam chamber 136 such that some of the water supplied from the second supply conduit 62 to the steam chamber 136 will remain in the trap portion even when the steam chamber 136 is empty of water. The water in the trap portion 166 forms a water plug that prevents steam from the steam chamber 136 backflowing into the water supply.

The liquid trap 164 is illustrated as being formed by the conduit 168 having a U-shaped 170 portion that holds water to form the liquid trap. The conduit 168 can be separate from or integrated with the second supply conduit 62. The water level in the U-shaped portion will vary depending on the operating conditions. However, if the U-shaped portion is located below the bottom of the of the steam generator tube 130, then a sufficient amount of water will be maintained in the U-shaped portion to completely block the interior of the conduit and form a water plug as previously described.

The conduit 168 has a second U-shaped portion 172 that connects the first U-shaped portion to the steam generator tube 130, such that an end 174 is fluidly connected to an upper portion of the steam generator tube 130, which negates the need for the lip 126 to retard the flow of deposits. As the end 174 enters the steam generator tube above the anticipated operating fill level of the steam generator, any entrained deposits are not likely to flow out of the steam generation chamber and into the conduit 168. The extension of the second U-shaped portion 172 above the steam generation chamber 136 further retards the entrained particles from passing out of the steam generation chamber 136.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fabric treatment appliance comprising:

a receptacle defining a fabric treatment chamber for receiving laundry;

a steam generator having an inlet operable to be coupled with a water supply for receiving water, a steam generation chamber for converting the water to steam, and an outlet coupled to the fabric treatment chamber for supplying steam to the fabric treatment chamber;

a reservoir fluidly coupled with the steam generator inlet and having a portion extending above the steam generator inlet; and a water supply conduit operable to fluidly couple the water supply with the reservoir and having an outlet located below the steam generator inlet;

wherein a liquid trap is formed between the water supply conduit and the steam generator inlet blocking backflow of steam from the steam generation chamber to the water supply.

2. The fabric treatment appliance according to claim 1 wherein the reservoir when supplied with water forms a water plug between the steam generator inlet and the water supply to form the liquid trap.

3. The fabric treatment appliance according to claim 1, further comprising a siphon break coupled with the reservoir.

4. The fabric treatment appliance according to claim 3 wherein the siphon break comprises a conduit fluidly coupled with atmosphere.

5. The fabric treatment appliance according to claim 1, further comprising a baffle located between the steam generation chamber and the reservoir to retard a flow of deposits entrained in the water from the steam generation chamber to the reservoir.

6. The fabric treatment appliance according to claim 1, further comprising a siphon break fluidly coupled with the water supply and the liquid trap.

7. The fabric treatment appliance according to claim 1 wherein the steam generator comprises an in-line steam generator.

8. The fabric treatment appliance according to claim 1 wherein the liquid trap comprises a conduit coupled with the inlet of the steam generator.

9. The fabric treatment appliance according to claim 8 wherein the conduit comprises a portion located below the inlet of the steam generator and forming the liquid trap.

10. The fabric treatment appliance according to claim 9 wherein the inlet of the steam generator is fluidly coupled to an upper portion of the steam generation chamber.

11. The fabric treatment appliance according to claim 9 wherein the portion of the conduit is located beneath the steam generation chamber.

12. The fabric treatment appliance according to claim 8 wherein the conduit comprises a first U-shaped portion forming the liquid trap.

13. The fabric treatment appliance according to claim 12 wherein at least a portion of the U-shaped portion lies beneath at least one of the inlet to the steam generator and the steam generation chamber.

14. The fabric treatment appliance according to claim 13 wherein the conduit comprises a second U-shaped portion fluidly coupled with the first U-shaped portion and the inlet to the steam generator.

15. The fabric treatment appliance according to claim 14 wherein at least a portion of the second U-shaped portion lies above at least one of the inlet to the steam generator and the steam generation chamber.

16. The fabric treatment appliance according to claim 15 wherein the inlet to the steam generator is located in an upper portion of the steam generation chamber.

* * * * *